United States Patent [19]

Nilson

[11] 3,981,419

[45] Sept. 21, 1976

[54] SELF-CLOSING CLOSURES

[75] Inventor: Billy N. Nilson, Mjolby, Sweden

[73] Assignee: KeNova AB, Malmo, Sweden

[22] Filed: Apr. 1, 1975

[21] Appl. No.: 564,079

[30] Foreign Application Priority Data

Apr. 8, 1974 Sweden ..... 7404749

[52] U.S. Cl. ..... 222/494

[51] Int. Cl.[2] ..... B65D 35/50

[58] Field of Search ..... 222/492–496, 222/491

[56] References Cited

UNITED STATES PATENTS

| | | | |
|---|---|---|---|
| 1,925,925 | 9/1933 | Kunkel | 222/494 |
| 2,002,723 | 5/1935 | Voke et al. | 222/493 |
| 2,556,571 | 6/1951 | Bobbs et al. | 222/494 X |
| 3,412,910 | 11/1968 | Hahn | 222/494 |

FOREIGN PATENTS OR APPLICATIONS

| | | | |
|---|---|---|---|
| 787,371 | 7/1935 | France | 222/493 |

*Primary Examiner*—Allen N. Knowles
*Assistant Examiner*—Norman L. Stack, Jr.
*Attorney, Agent, or Firm*—Finnegan, Henderson, Farabow & Garrett

[57] ABSTRACT

A self-closing closure comprises two annular parts intended to be snapped together one of said parts being integral with a conical diaphragm having a central sleeve-shaped part with a discharge opening whereas the other one has radial spokes ending in a central part from which a stem projects. The end of said stem normally fills the opening of the sleeve and, to obtain an improved discharge function the end of the stem is substantially cylindrical and continues in a slightly conical part whereas the discharge opening has a cylindrical end portion smoothly continuing inwardly in a conical portion the inner envelope surface of the discharge opening being convex to establish a linear contact with the conical part of the stem. The end portion of the stem may be tubular.

8 Claims, 4 Drawing Figures

SELF-CLOSING CLOSURES

This invention refers to self-closing closures intended to be connected to or integral with containers, tubes and the like. More specifically the invention refers to such closures which have the ability of opening in response to a pressure exerted upon the material contained in such a container. To obtain such a pressure the container may have a propellant gas therein but it may also have flexible walls thereby enabling a person to generate the pressure manually by pressing or squezing the container.

One object of the invention is to realize a closure of the kind referred to which consists of two parts which may be easily connected to each other as well as to a tube wall or similar part of a package and which is simple and cheap to manufacture.

Another object is to obtain a dischage of the material from a closure in a continuous flow which is cut off immediately when the pressure thereon ceases any subsequent leakage being effectively prevented.

Still another object is to provide a closure structure in which the parts thereof are well protected against damages occurring in the use or transport thereof.

Further objects and advantages of the invention will be apparent from the description of the invention as well as from the claims.

Figure 1:
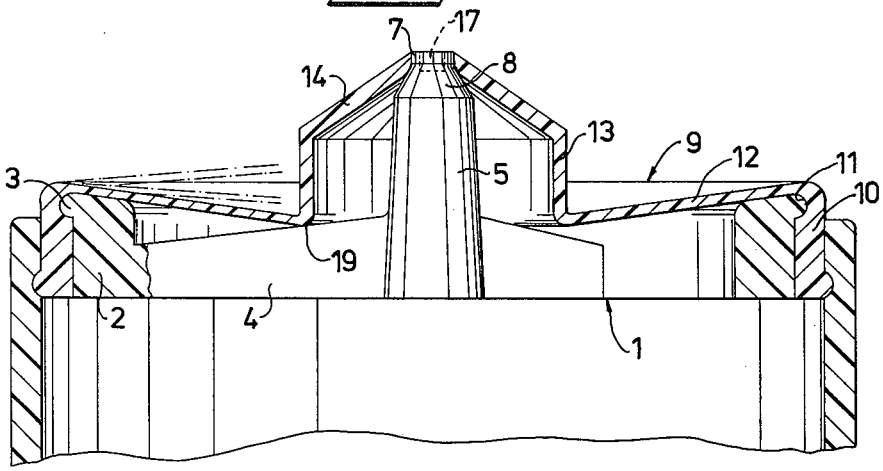
Figure 2:
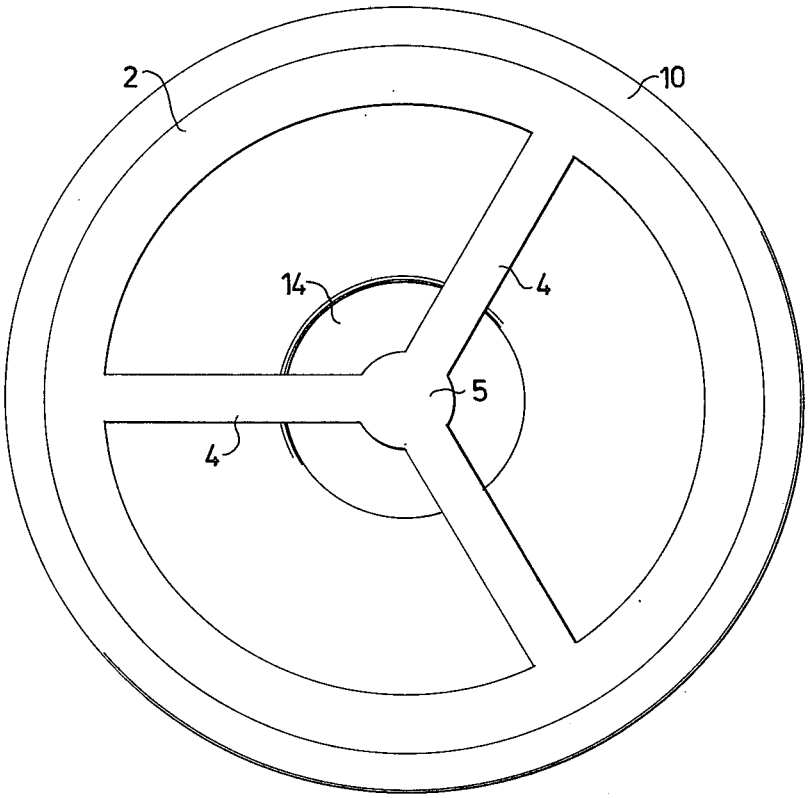
Figure 3:
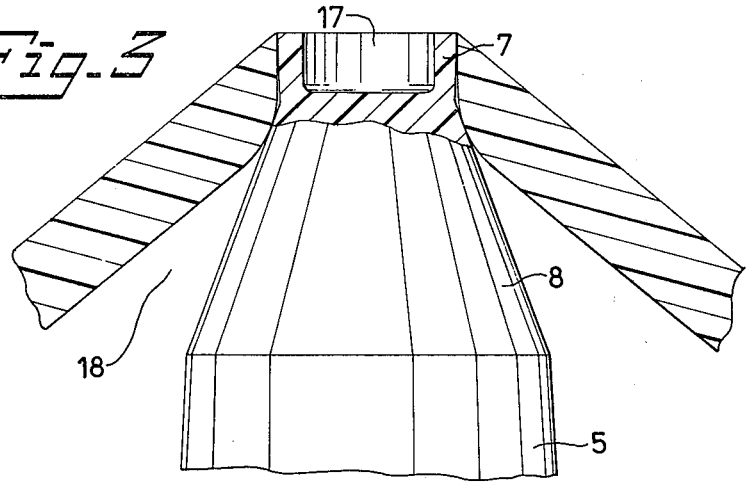
Figure 4:
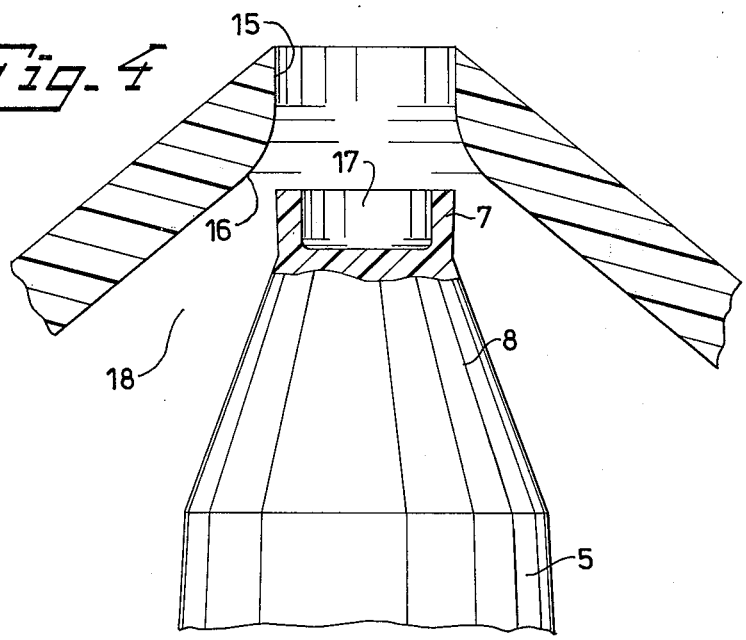

FIG. 1 is a section through the upper part of a tube provided with a closure according to the preferred embodiment of the invention, FIG. 2 shows on a reduced scale compared to FIG. 1 the parts of the closure in an assembled condition and seen from the under side thereof, FIG. 3 shows on a bigger scale the cooperating parts of the closure in their active position, i.e. in the closed position of the closure, FIG. 4 shows on a bigger scale the parts according to FIG. 3 but during the discharge operation.

In the drawing numeral 1 generally designates a first member of the closure. This member is preferably made from polypropylene or an equivalent thereto and in an injection molding process. Member 1 includes an annular connection part 2 which in the illustrated embodiment has an outwardly directed annular bead 3. Integral with said connection part 2 are a number of inwardly directed ribs or spokes 4 which meet in a central portion. From said portion projects an upwardly extending stem 5, stem 5 has an end portion 7 which is slightly conical having its wider part at the free end thereof. The end portion 7 continues inwardly in a conical portion 8.

The second member of the closure is generally designated 9 and is preferably made in a manner similar to that of member 1. The second member has an outer annular portion 10 which in its inner surface has an annular groove 11 for containing the bead 3. Integral with said annular portion 10 is a very thin disc-shaped portion 12, which serves as a diaphragm and is referred to as a diaphragm in this description. Said diaphragm continues in a sleeve 13 which has a conical end portion 14. Said end portion 14 has a discharge opening of a special design which is apparent from FIG. 3 and FIG. 4. The discharge opening has a substantially cylindrical opening 15 intended to sealingly receive the end portion 7 of the stem. This cylindrical opening 15 continues inwardly in a conical opening 16 which has a convex inner envelope surface. As appears from the drawing the transition between the cylindrical opening 15 and the conical opening 16 is very smooth and in practice follows a radius or similar curved line.

The diaphragm 12 is prefrably mounted with tension which means that its conicity before the mounting is somewhat bigger than its conicity in the mounted condition thereof. It is obvious that the sleeve 13 will thus engage the stem with a predetermined tension.

The closure now described functions as follows:

A pressure exerted upon the material contained in the container causes the central portion of said diaphragm to be flexed upwardly. Consequently the sleeve 13 will take the position shown in FIG. 4 in which the end portion 14 of said sleeve has raised to a position in which the discharge opening is out of contact with the end of the stem. In this position of the cooperating parts the discharge operation takes place. A continued pressure upon the material will separate the parts still more and as a consequence thereof the discharge opening will be increased accordingly. When the pressure ceases the elastic properties of the material from which the closure parts are made will bring the parts back to their initial position shown in FIG. 3. In this position the closure is in its closed position and no material is now discharged.

The specific design of the stem and the discharge opening ensures the proper function of the closure. The substantially cylindrical end portion 7 of stem 5 has approximately the same diameter as the substantially cylindrical opening 15 of the sleeve and a sealing effect is then achieved at the top of the stem but in addition thereto the function of sealing depends upon the presence of a linear contact between the conical portion 8 of stem 5 and the conical and convex opening 16. Owing to the fact that said conical and convex opening tangentially contacts said conical portion 8 the attained effect is realized. The composite sealing structure gives as a result that the flow of material discharged from the container is distinctly cut off as soon as the pressure upon the material in the container ceases. In this moment the parts return from the position in FIG. 4 to the position illustrated in FIG. 3 where an effective sealing of the opening is effected. Thus a reliable and soft discharge of fluids of any viscosity is obtained. As appears from FIG. 3 and 4 the design of the opening 16 and the part 8 of the stem 5 effect an annular channel 18 between parts 16 and 8 having an area which successively diminishes towards the end of the closure which has a favorable influence upon the discharge sequence. The rounded opening 16 further eliminates the deposition of material at the operating parts of the closure which in practice means that the closure is self-cleaning. The rounded convex shape also serves to positively guide the stem into opening 15 while giving no obstacles to the guiding movement. The combination of the conical surface 8 and the convex surface 16 further guarantees that a linear contact is maintained also when a certain pressure tends to press the surfaces towards each other. Such a pressure may however not reach such value that it leads to the parts jamming together which would cause the discharge operation to take place in an irregular jerking manner. The opening would also be deformed with leakage as a consequence. Such an exaggerated pressure may occur by mistake for instance when sleeve 13 is pressed down. In order to avoid such unwanted jamming the lower portion 19 of sleeve 13 is arranged at such a short distance from the ribs 4 that the depression of sleeve 13 which can take place cannot cause the jamming in question.

In order to guarantee an effective sealing between the cylindrical end portion 7 of stem 5 and the cylindrical portion 15 of member 9 said end portion may be provided with a hole 17 making said end portion tubular at least in part of its extension. Such a measure also enables said end portion to adapt its shape to the contour of the opening 15 which means that a slight deformation of said opening 15 may be neglected. The tubular shape also prevents material deposits at the end of part 7 and ensures the cutting off effect referred to.

An effective transport seal may be arranged by using the hole 17 of the stem to receive a cylindrical pin having an upper flange which is intended to act upon the upper part of sleeve 13 thereby preventing the displacement of said sleeve relative to the stem.

The fact that the parts of the closure may be snapped together by means of the bead 3 and the groove 11 makes it possible to produce the closure as a separate unit that may be connected to a package of any suitable kind and the assembly can take place in a very simple manner.

What I claim is:

1. A closure for use with a container, the closure opening in response to pressure upon the contents of the container, and being self-closing upon the release of pressure, said closure comprising a first part having a discharge opening, and a second part having a projection extending toward said opening in said first part and closing said opening when said closure is in the closed position, said discharge opening having a substantially cylindrical shape and changing at the interior of the opening to an annular, curved convex surface, said projection having a substantially cylindrical tip sized to be sealingly received in the cylindrically shaped discharge opening in the closed position of said closure and a conical portion diverging outwardly from said cylindrical tip for establishing linear sealing contact with the annular convex surface of said discharge opening in the closed position of said closure, whereby sealing engagement between the projection and the discharge opening is attained at two places.

2. A closure as claimed in claim 1 wherein the tip of the projection contains a recess to impart to said tip a substantially tubular construction.

3. A closure as claimed in claim 1 wherein said substantially cylindrical tip diverges slightly inwardly from its free end to said conical portion to thereby impart to said tip a slightly conical shape.

4. A closure as claimed in claim 1 wherein said first part has a flexible, resilient diaphragm which moves upon application of opening pressure to the contents of the container to withdraw the opening of said first part away from the projection of said second part to open the closure and permit expulsion of the contents from the container.

5. A closure as claimed in claim 4 wherein said first part is formed outwardly of said second part and said flexible, resilient diaphragm of said first part forms in the closed position a convex surface facing toward said second part, said convex surface changing to a concave surface upon the application of opening pressure to the contents of the container and returning to a convex surface upon the release of opening pressure.

6. A closure as claimed in claim 5 wherein said first part has a first annular rim connected to said flexible, resilient diaphragm and said second part has a second annular rim connected to the first rim and a plurality of ribs connecting the second rim to said projection.

7. A closure as claimed in claim 6 wherein said flexible, resilient diaphragm contacts the ribs of said second part in the closed position, thereby limiting axial deflection of said diaphragm in a direction opposite to the discharge direction.

8. A self-closing closure as claimed in claim 7, wherein the closure is attached to a tube.

* * * * *